US010988863B2

(12) United States Patent
Heißel et al.

(10) Patent No.: US 10,988,863 B2
(45) Date of Patent: Apr. 27, 2021

(54) CARD WIRE

(71) Applicant: Groz-Beckert KG, Albstadt (DE)

(72) Inventors: Peter Heißel, Krauchenwies (DE); Stefan Lohrmann, Rosenfeld (DE)

(73) Assignee: Groz-Beckert KG, Albstadt (DE)

( * ) Notice: Subject to any disclaimer, the term of this patent is extended or adjusted under 35 U.S.C. 154(b) by 89 days.

(21) Appl. No.: 16/165,338

(22) Filed: Oct. 19, 2018

(65) Prior Publication Data

US 2019/0119832 A1 Apr. 25, 2019

(30) Foreign Application Priority Data

Oct. 20, 2017 (EP) ..... 17197463

(51) Int. Cl.

| | |
|---|---|
| ***D01G 15/84*** | (2006.01) |
| ***D01G 15/46*** | (2006.01) |
| ***D01G 15/26*** | (2006.01) |
| ***D01G 15/88*** | (2006.01) |

(52) U.S. Cl.

CPC ..... *D01G 15/84* (2013.01); *D01G 15/26* (2013.01); *D01G 15/465* (2013.01); *D01G 15/88* (2013.01)

(58) Field of Classification Search

CPC ..... D01G 15/84; D01G 15/88; D01G 15/26; D01G 15/465

USPC ..... 19/114

See application file for complete search history.

(56) References Cited

U.S. PATENT DOCUMENTS

| | | | | |
|---|---|---|---|---|
| 4,625,367 | A * | 12/1986 | Sole-Leris | D01G 15/88 19/113 |
| 5,642,611 | A * | 7/1997 | Stahlecker | D01H 4/32 19/112 |
| 5,755,012 | A * | 5/1998 | Hollingsworth | D01G 15/24 19/114 |
| 6,408,487 | B1 * | 6/2002 | Atkinson | D01G 15/88 19/114 |

(Continued)

FOREIGN PATENT DOCUMENTS

| | | |
|---|---|---|
| DE | 19509743 A1 | 9/1996 |
| EP | 2489766 A2 | 8/2013 |

(Continued)

OTHER PUBLICATIONS

Extended European Search Report dated Apr. 18, 2018 for corresponding EP application No. 17197463 (5 pages).

*Primary Examiner* — Khoa D Huynh
*Assistant Examiner* — Aiying Zhao
(74) *Attorney, Agent, or Firm* — Fitch, Even, Tabin & Flannery LLP

(57) ABSTRACT

A card wire has consecutive teeth spaced apart in the longitudinal direction by a pitch. The teeth are bounded in the longitudinal direction by a tooth face on a first side and by a tooth back on a second side. Looking downwards in the height direction of the card wire, the tooth face and the tooth back of consecutive teeth merge in a tooth base and, looking upwards in the height direction, form a tooth tip. The tooth depth is defined by the greatest distance, in the height direction of the card wire, from the tooth tip to the tooth base. The ratio of pitch to tooth depth is less than 1.1. An interspace, measured at right angles to a tangent to an inflection point between tooth back and tooth base, between this inflection point and the opposite tooth face is greater than a quarter of the pitch.

7 Claims, 2 Drawing Sheets

(56) References Cited

U.S. PATENT DOCUMENTS

| | | | | |
|---|---|---|---|---|
| 2014/0338154 | A1* | 11/2014 | Zhang | D01G 15/88<br>19/99 |
| 2016/0138201 | A1* | 5/2016 | Bocht | D01G 15/88<br>19/114 |
| 2017/0121863 | A1* | 5/2017 | Gabler | D01G 15/88 |

FOREIGN PATENT DOCUMENTS

| | | | |
|---|---|---|---|
| WO | 2000/026450 | A1 | 5/2000 |
| WO | 2011/138322 | A1 | 11/2011 |
| WO | 2013/037711 | A1 | 3/2013 |

* cited by examiner

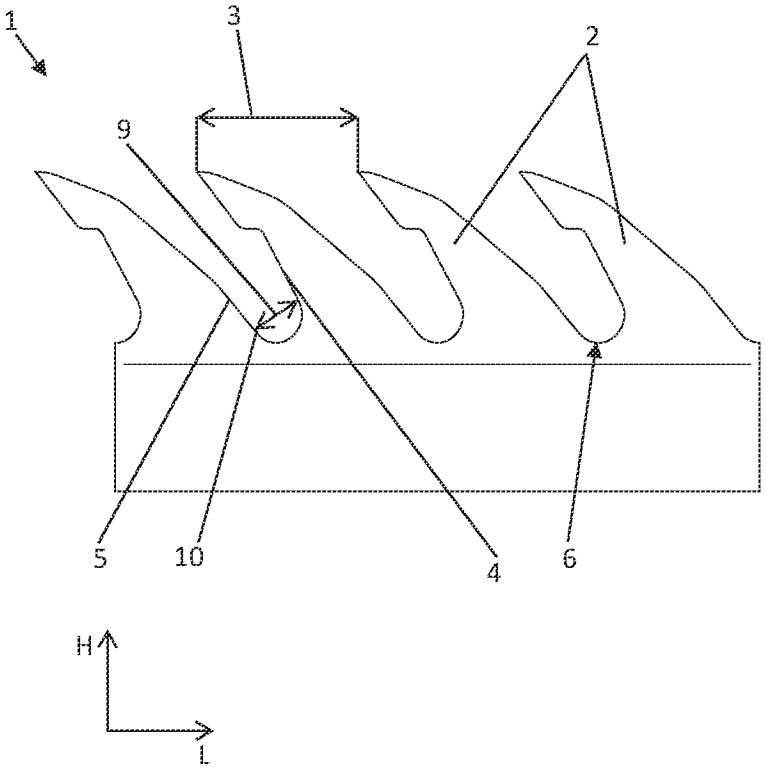
Fig. 1 - Prior Art
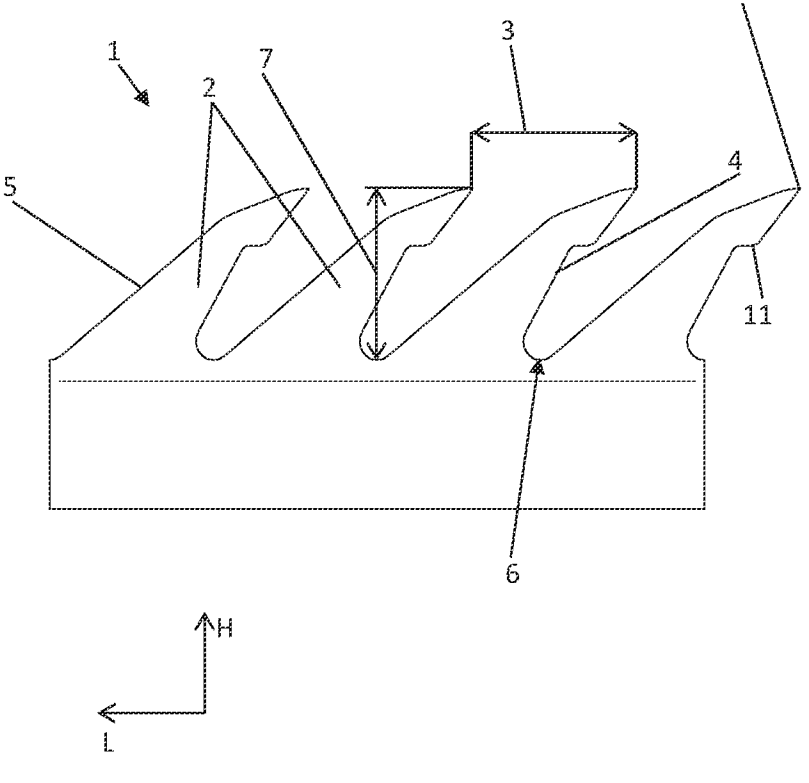
Fig. 2

CARD WIRE

This application claims the benefit of European Patent Application No. 17197463.7, filed Oct. 20, 2017, the contents of which is incorporated herein by reference as if fully rewritten herein.

TECHNICAL FIELD

The invention relates to a card wire for a roller of a carding machine.

BACKGROUND

Carding machines, cards or carders are used to open (individualize) and align the fibres of a fibrous material, e.g. of wool, cotton, synthetic fibres or of a fibre blend, to homogenize them (for fleece production) and/or to parallelize them (for yarn production). The carding process may be used to produce a fibre mat from a fibrous material. The fibre mat consists of a loose collection of ordered individual fibres. A nonwoven, for example, may be produced from a fiber mat of this kind. During carding, the fibre mat is formed by removing the fibres, by way of a removal means, from a large carding roller, also known as the cylinder, and combining them.

The carding machine may have various carding rollers, each of which has teeth, serrations or spikes projecting outwards in approximately radial direction. The number and/or size and/or density of the teeth, serrations or spikes, as well as their shape and configuration, may vary.

Carding rollers are generally provided with all-steel card clothing. This consists of a profiled card wire wound under tension onto the carding roller in question. The card wire has a foot segment and a blade segment. The foot segment may have, for example, a rectangular or square cross section. In the operating position, the blade segment projects away from the foot segment approximately at right angles to the curved surface of the carding roller. The blade segment features a sawtooth profile for the formation of teeth or serrations. The card wire is wound, under longitudinal tension, around the curved surface of the carding roller, and the two ends are attached to the carding roller.

Known card wires exist in many different configurations, and special groups of card wires, each with specific geometric features, are proposed for different functions of the particular carding roller in the carding machine.

WO00/26450A1, WO2011/138322A1 and WO2013/037711A1 show card wires which are especially suitable for rollers generally known as workers, doffers or transfer rollers. In comparison with the total height of the card wire, the teeth of these card wires are typically punched relatively deep, with the tooth face leaning relatively far forwards towards the foot segment. The tooth face is the side of the tooth that makes direct contact with the fibres during carding. The cited publications show portions of the tooth face that lean even further towards the foot of the clothing in order to enhance the carding effect of the clothing. A portion of the tooth face which leans more strongly towards the foot of the clothing may be termed an undercut. An undercut of this kind may negatively influence the stability of the teeth, especially if consecutive teeth come closer together. WO2013/037711A1 accordingly proposes a special geometry for the tooth face, in particular in the undercut, as a refinement of WO00/26450A1.

If the card wires in the above-cited publications, but also card wires without an undercut for worker, doffer or transfer rollers, have a small tooth pitch compared with the tooth depth, they have the disadvantage that, near to the tooth base, fibers may jam in the tooth gap and, with time, cause the clothing to clog. Even if not many fibres are normally held in the lower section of the tooth gap (near the tooth base), an undesirable pile-up of fibres may occur rapidly once the first fibres have jammed.

The objective of this invention is to provide a card wire with which fibres jam less easily and clogging of the clothing is reduced.

SUMMARY

The card wire of the invention is especially suitable for the clothing of a doffer roller, a worker roller or a transfer roller. In its longitudinal direction, the card wire has consecutive teeth, which are spaced apart in the longitudinal direction by a distance known as the pitch. The pitch may be measured advantageously from tooth tip to tooth tip. The teeth are bounded in the longitudinal direction by a tooth face on a first side and by a tooth back on a second side. As seen looking down in the height direction of the card wire, the tooth face and the tooth back of consecutive teeth merge in a tooth base. As seen looking up in the height direction of the card wire, the tooth face and the tooth back form the tooth tip at their point of intersection. The tooth depth is defined by the greatest distance, in the height direction of the card wire, from the tooth tip to the tooth base. If the mathematical ratio of pitch to tooth depth is less than 1.1, conditions prevail that favour the jamming of fibres in the lower section of the tooth gap. The card wire of the invention is characterised in that an interspace, measured at right angles to a tangent to an inflection point between tooth back and tooth base, between this inflection point and the opposite tooth face is greater than a quarter of the pitch. It is also advantageous if the distance is greater than the quotient of the pitch and 3.5, or greater than the quotient of the pitch and 3. Thanks to the greater distance between consecutive teeth in the lower portion of the tooth gap, fibres jam less often in this lower portion of the tooth gap and the clothing clogs less frequently. The larger distance additionally has the synergistic effect that the surface on the tooth face is smoother in many of the card wires in question. In consequence, the initial jamming of fibres becomes even less frequent because the fibres are able to slide more easily on the surface. As is known, the surface of most of the card wires concerned undergoes a finishing process at a late stage of their production, the purpose of which is also to smooth the surface. Where the distance between the teeth is greater, this process produces enhanced smoothness.

The inflection point at the transition between tooth back and tooth base may be determined non-ambiguously as follows: except for localized shape elements such as elevations or depressions, the tooth back has, essentially at every point, a tangent that encloses an acute angle with the longitudinal direction. In the tooth base there is at least one point at which the tangent to the card wire runs in the longitudinal direction. Starting from this point with a tangent to the tooth back running in the longitudinal direction, the inflection point is at the first position at which, compared with the nearest preceding point, the angle enclosed by the tangent and the longitudinal direction assumes a smaller or equal value.

The card wire according to the invention preferably has a pitch of less than 3.2 mm. A pitch of less than 2.6 mm is particularly advantageous.

At the tooth face, the card wire may enclose an angle between 45° und 65° with the longitudinal direction. At the tooth face, the card wire may enclose an angle between 50° und 60° with the longitudinal direction. It may be particularly advantageous if this angular portion exists on the tooth face below a possibly existent steeper tip section and below a possibly existent undercut. The tooth face may be straight and have a single angular value over this portion. However, it is also possible for the tooth face to be curved and for it to assume different angles over this angular portion.

The card wire may be configured as a circular arc in the tooth base. A rounded tooth base is particularly advantageous because there are then no edges or corners at which fibres jam more easily. The rounded tooth base advantageously transitions tangentially and kink-free into the bordering tooth back and the bordering tooth flank.

The radius in the tooth base of the card wire may exceed one eighth of the pitch. A radius greater than 0.4 mm may be particularly advantageous. A radius that exceeds one seventh or one sixth of the pitch is also advantageous.

The card wire may have a tooth back with two or more straight sections. A straight section that borders on the tooth base may enclose a larger angle with the longitudinal direction of the card wire than another straight section of the tooth back. The straight section bordering on the tooth base preferably transitions tangentially into the tooth base. The straight section, bordering on the tooth base, of the tooth back of the card wire preferably extends upwards towards the tooth tip for a maximum distance of 50% of the tooth depth. For one thing, this ensures that the teeth are the required distance apart at the tooth base. For another, this nevertheless enables the teeth to be configured with the requisite small pitch and still to have a tooth face that encloses a small angle with the longitudinal direction or has an undercut.

The card wire may have an undercut in the tooth face. The undercut leans more strongly towards the longitudinal direction than does the adjoining part of the tooth face below the undercut. In other words, the undercut encloses a smaller angle with the longitudinal direction than does the adjoining portion of the tooth face. The angle enclosed between the undercut and the longitudinal direction is preferably between 0° and 40°. The angle enclosed between the undercut and the longitudinal direction may be between 5° and 35°.

The foot segment of the card wire according to the invention may be freely selected to suit the specific application. The card wire may have, for example, prism- or v-shaped interlocking foot segments or plain rectangular ones.

BRIEF DESCRIPTION OF THE DRAWINGS

FIG. 1 shows a card wire according to the prior art.

FIG. 2 shows an embodiment of a card wire according to the invention.

DETAILED DESCRIPTION

Figure 3:
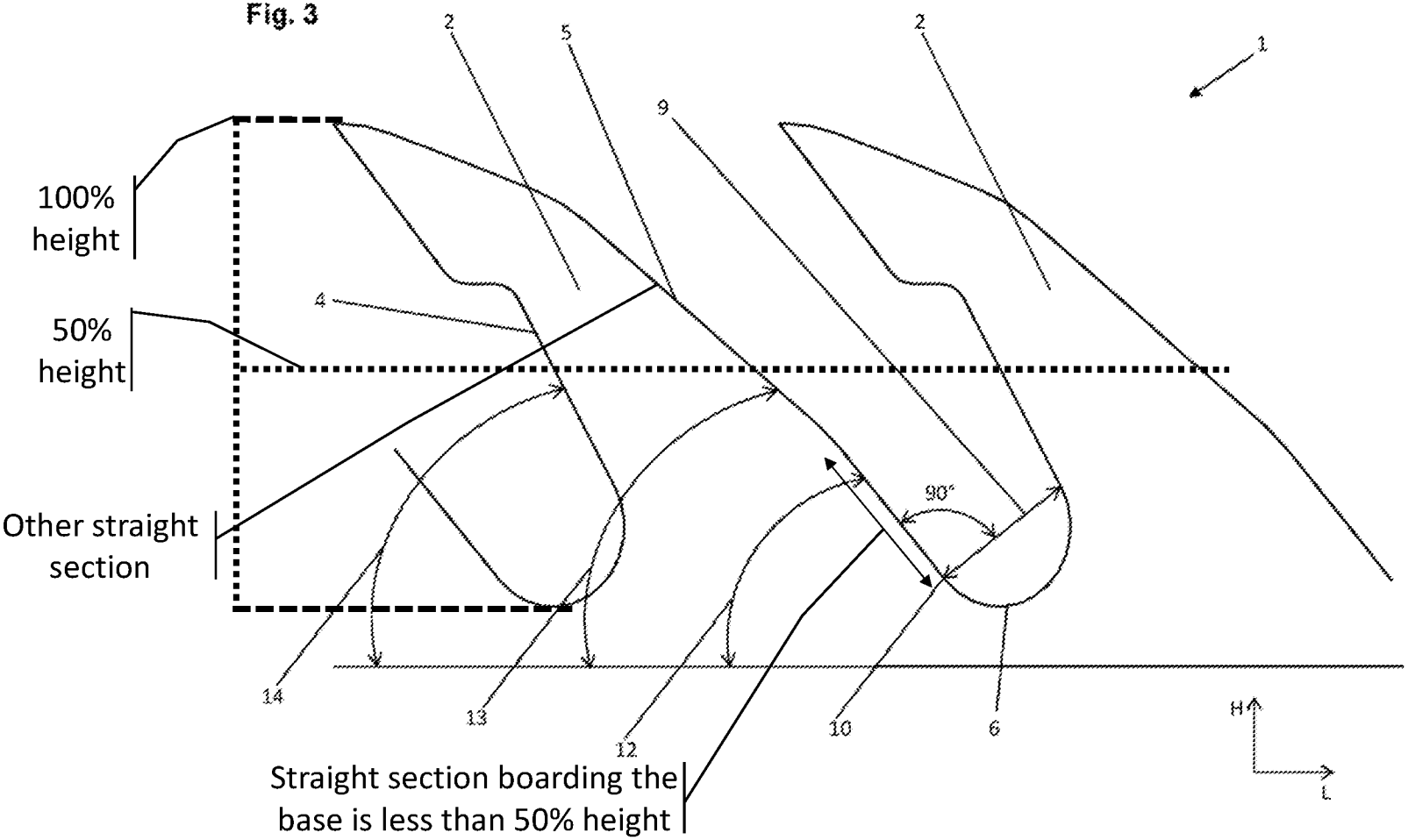
FIG. 3 shows an enlarged detail from FIG. 2.

FIG. 1 shows a card wire (1) according to the prior art. It shows a section of a card wire comprising 4 teeth (2). The card wire (1) is shown in a view perpendicular to the longitudinal direction (L) and perpendicular to the height direction (H). The pitch (3) and the tooth depth (7) are shown with arrows. The pitch (3) is measured in the longitudinal direction (L), the tooth depth in the height direction (H). The reference lines for the arrow showing the pitch (3) start from two tooth tips (8) of consecutive teeth (2). The arrow showing the tooth depth (7) runs between the deepest point of a tooth base (6) and a reference line, which again starts from a tooth tip (8). The card wire (1) illustrated has an undercut (11). Below the undercut (11), the tooth back (5) and the tooth face (4) are straight. Above the undercut (11), in the direction of the tip, the tooth back (5) and the tooth face (4) have differing portions.

The card wire according to the invention, shown in FIG. 2, corresponds for the most part to the card wire of FIG. 1. In the tooth base (6), the card wire (1) has an interspace (9), which exceeds a quarter of the pitch (3). The interspace (9) is measured from an inflection point (10) at the transition between the tooth base (6) and the tooth back (5) to the face (4) of the next tooth. For better clarity, a detail from FIG. 2 is shown enlarged in FIG. 3.

FIG. 3 shows two teeth (2) of a card wire (1) according to the invention. The foot segment is no longer shown in full, but has been cut off at the lower edge of FIG. 3. It is particularly evident that, starting from the inflection point (10), the interspace (9) is measured at an angle of 90° to the tangent at the inflection point (10). The tooth base (6) is circular-arc-shaped and transitions tangentially into the tooth back (5). Starting from the inflection point (10) in the upward direction, the tooth back (5) is straight. The angle of the tangent at the inflection point (10), at which the circular arc of the tooth base (6) transitions tangentially into the bordering straight section of the tooth back (5), does not change over the entire first straight section of the tooth back (5). This means that the inflection point (10), in accordance with its definition, is fixed non-ambiguously at the position shown. The straight section bordering on the tooth base (6) encloses a larger angle (12) with the longitudinal direction (L) than the angle (13) formed by a straight section further up. The angle (14) formed by the tooth face (4) is shown for the sake of completeness.

| List of reference numerals | |
|---|---|
| 1 | Card wire |
| 2 | Tooth |
| 3 | Pitch |
| 4 | Tooth face |
| 5 | Tooth back |
| 6 | Tooth base |
| 7 | Tooth depth |
| 8 | Tooth tip |
| 9 | Interspace |
| 10 | Inflection point |
| 11 | Undercut |
| 12 | Angle formed by the straight portion, bordering on the tooth base, of the tooth back |
| 13 | Angle formed by another straight portion |
| 14 | Angle formed by the tooth face |
| L | Longitudinal direction of the card wire |
| H | Height direction of the card wire |

The invention claimed is:

1. Card wire (1) comprising in its longitudinal direction (L), consecutive teeth (2) which are spaced apart in the longitudinal direction (L) by a pitch (3), wherein the teeth (2) are bounded in the longitudinal direction (L) by a tooth face (4) on a first side and by a tooth back (5) on a second side, wherein, looking downwards in a height direction (H) of the card wire (1), the tooth face (4) and the tooth back (5) of consecutive teeth (2) merge in a tooth base (6)

and, looking upwards in the height direction (H) of the card wire (1), form a tooth tip (8), wherein a tooth depth (7) is defined by a greatest distance, in the height direction (H) of the card wire (1), from the tooth tip (8) to the tooth base (6), wherein a ratio of pitch (3) to tooth depth (7) is less than 1.1, wherein an interspace (9), measured at right angles to a tangent to an inflection point (10) between tooth back (5) and tooth base (6), between this inflection point (10) and an opposite tooth face (4) is greater than a quarter of the pitch (3), wherein the tooth base (6) is shaped as an arc having a radius greater than one or both of one eighth of the pitch (3) or 0.4 mm.

2. Card wire (1) according to claim 1, wherein the pitch (3) is less than 3.2 mm.

3. Card wire (1) according to claim 1, wherein an angle enclosed by the tooth face (4) and the longitudinal direction (L) is between 45° and 65°.

4. Card wire (1) according to claim 1, wherein the tooth back (5) comprises at least two straight sections, wherein one straight section of the at least two straight sections, which borders on the tooth base (6), encloses a larger angle with the longitudinal direction (L) than does another of the at least two straight sections.

5. Card wire (1) according to claim 4, wherein a maximum extent of the straight section bordering on the tooth base (6) is 50% of the tooth depth (7).

6. Card wire (1) according to claim 1, wherein the tooth face (4) has an undercut (11).

7. Card wire (1) according to claim 6, wherein the undercut (11) in the tooth face (4) encloses an angle of 0° to 45° with the longitudinal direction (L).

* * * * *